US005785384A

United States Patent [19]

Sagstuen

[11] Patent Number: 5,785,384

[45] Date of Patent: Jul. 28, 1998

[54] ARRANGEMENT IN AN ADJUSTABLE CHAIR

[75] Inventor: Morten Sagstuen, Lillehammer, Norway

[73] Assignee: Handicare Industri A/S, Lillehammer, Norway

[21] Appl. No.: 817,116

[22] PCT Filed: Oct. 10, 1995

[86] PCT No.: PCT/NO95/00186

§ 371 Date: Apr. 8, 1996

§ 102(e) Date: Apr. 8, 1996

[87] PCT Pub. No.: WO96/11610

PCT Pub. Date: Apr. 25, 1996

[30] Foreign Application Priority Data

Oct. 14, 1994 [NO] Norway ..... 943892

[51] Int. Cl.[6] ..... A47C 1/02

[52] U.S. Cl. ..... 297/317; 297/DIG. 4

[58] Field of Search ..... 297/316, 317, 297/318, 320, 322, DIG. 4, 340, 341, 342

[56] References Cited

U.S. PATENT DOCUMENTS

| | | | |
|---|---|---|---|
| 809,944 | 1/1906 | Hanger | 297/318 X |
| 3,572,829 | 3/1971 | Malitte | 297/317 |
| 4,759,561 | 7/1988 | Janssen . | |
| 4,865,384 | 9/1989 | Desanta | 297/320 X |

FOREIGN PATENT DOCUMENTS

| | | | |
|---|---|---|---|
| 1473282 | 3/1967 | France | 297/317 |
| A-3822877 | 1/1990 | Germany . | |
| 1278501 | 6/1972 | United Kingdom . | |

*Primary Examiner*—Milton Nelson, Jr.
*Attorney, Agent, or Firm*—Hazel & Thomas, P.C.

[57] ABSTRACT

A device for an adjustable chair, where the back of the chair, at a first mounting site on each side thereof, is pivotally connected to respective side members of the chair, and at a second mounting site forms a hinged connection with a rear part of the chair set frame, where the chair seat frame, at a front mounting site on each side thereof, is slidably connected to a respective side member along a front guide which forms a part of the side member. The first mounting site on the chair back is designed to slide along a rear, forward and downward inclining guide in the side member, and the seat frame has on each side a rear mounting site between said front mounting site and said second mounting site for the chair back, said rear mounting site forming a slidable connection with a guide in each respective side member, which is located between the front and rear guides when seen in the longitudinal direction of the side member which is either horizontal or inclines slightly forward and upward.

7 Claims, 8 Drawing Sheets

ARRANGEMENT IN AN ADJUSTABLE CHAIR

BACKGROUND OF THE INVENTION

The present invention relates to a device for an adjustable chair, where the back of the adjustable chair at a first mounting site on each side thereof is pivotally connected to respective side members of the chair, and at a second mounting site forms a hinged connection with a rear part of the chair seat frame, where the chair seat frame, at a front mounting site on each side thereof, slidably connected to one of the to respective side members along a front guide which forms a part of the side member, wherein said first mounting site on the chair back is designed to slide along forward and downward inclining rear guide in the side member, and wherein the seat frame on each side has a rear mounting site between said front mounting site and said second mounting site for the chair back, said rear mounting site forming a slidable connection with a central guide in each respective side member, which is located between the front guide and the rear guide when seen in the longitudinal direction of the side member.

From the prior art, reference shall be made to GB Patent No. 1278501, DE Patent No. 3822877, U.S. Pat. No. 4,759,561, and also a chair marketed under the trade mark STRESSLESS®. The last-mentioned chair type is also characterised, inter alia, in that the centre of gravity of the body in relation to the chair is kept virtually constant, usually near or above the central frame of the chair, if the chair is of the swivel type. A major aspect of the known chair type is, however, that when the back tips backward the lower end of the chair back remains at the same level as the back edge of the chair seat. This is due to the seat back and the chair seat being connected to one another at the lower edge of the chair back and the rear edge of the chair seat, respectively. When the chair user leans backwards in the chair, he may experience the sensation of the chair back apparently "climbing" up his back a little. On leaning back it is, of course, important that the head rest and similar are felt to be approximately in the same place irrespective of the sitting position.

This problem is nonetheless important in connection with adjustable wheelchairs, where being able to adjust the back in relation to a fixed seat or having the seat and back then rigidly connected to one another and be tiltable or adjustable as a unit are typical configurations. Furthermore, it has been known in connection with adjustable wheelchairs that these require at least one support leg which projects out behind the large wheelchair wheels to prevent the chair from tipping backward when the chair user leans back in the chair.

SUMMARY OF THE INVENTION

It has thus been one of the objects of the present invention to provide a device for an adjustable chair of the aforementioned type, wherein the aforementioned drawbacks both in normal adjustable chairs of this kind and especially in wheelchairs can be remedied. The invention seeks in the first place to provide good sitting comfort in an adjustable chair of this kind, and in the event of the invention being applied for use in a manual wheelchair, the otherwise good sitting comfort of the comfort wheelchair will be capable of being combined with the driving and transport properties of the active wheelchair. The object of the present invention, especially in connection with a wheelchair, is to be able to combine an "active driving position" with a "passive resting position" in one and the same wheelchair.

According to the invention, the device mentioned by way of introduction is characterized in that the front guide is inclined forward and upward and forms an angle with the horizontal in the range of 10°–45°, that the central guide forms an angle with the horizontal in the range of 0°–15°, and that the rear guide is slightly curved, and forms an angle with the horizontal in the range of 15°–45°.

In a preferred embodiment, the central guide is inclined forward and upward with an angle not exceeding 15° relative to the horizontal.

According to a further embodiment of the device, the side members are preferably made of extruded aluminium, said guides being formed by milling out grooves in a side surface of the side member. Said grooves may optionally be provided with a slide lining.

The front mounting site and the front guide are suitably formed such that friction therebetween is adjusted by means of a steplessly adjustable mechanism.

In order to ensure that the chair user does not experience the sensation of the chair back apparently "climbing up" his back, the back of the chair is to advantageously provided at the bottom with a frame member which projects forward in the longitudinal direction of the chair and forms an obtuse angle with the upwardly projecting part of the back, the free end of the frame member forming a part of said second mounting site.

As mentioned above, the present device exhibits special advantages in connection with use in a wheelchair, although the device may just as readily be used for any form of easy chair.

BRIEF DESCRIPTION OF THE DRAWINGS

The invention will now be explained in more detail below with reference to the accompanying drawings.

DETAILED DESCRIPTION OF THE PREFERRED EMBODIMENTS

Figure 1:
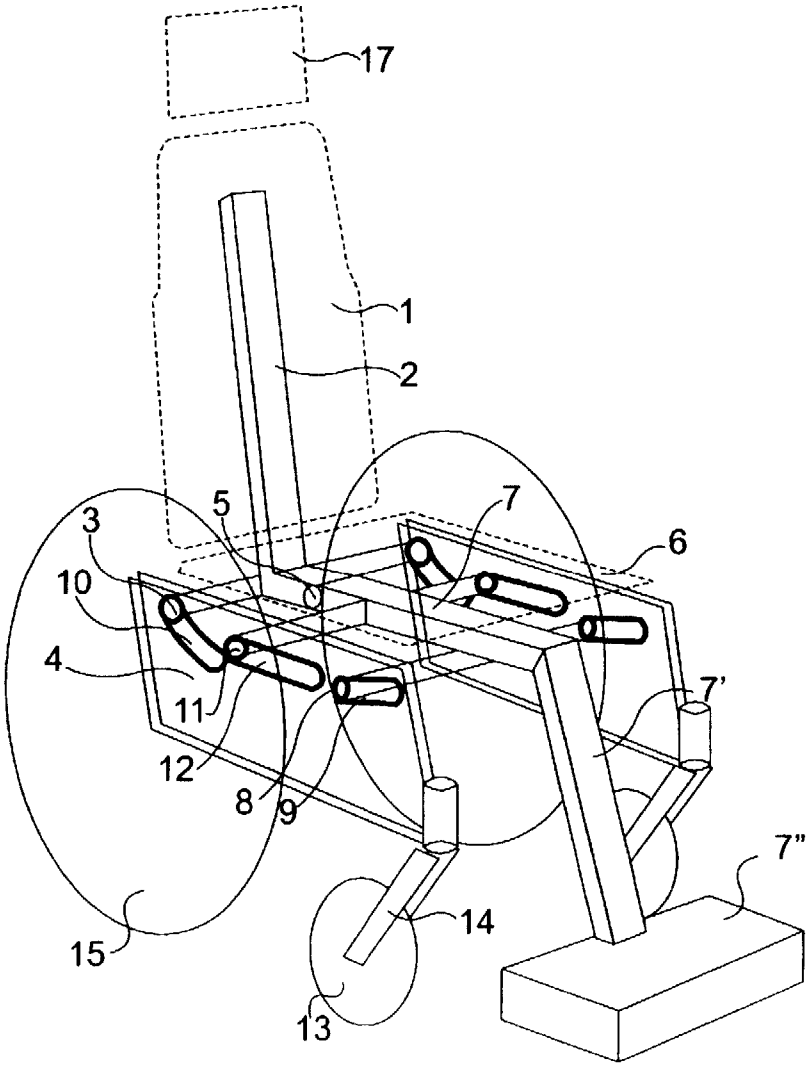
FIG. 1 is schematic illustration of the device according to the invention applied to a wheelchair structure.

In FIG. 1, the device according to the invention is shown in connection with a wheelchair solution. The wheelchair parts are only illustrated schematically in order not to complicate the understanding of the mode of operation of the device.

The back 1 of the chair is connected to a chair back frame 2 which, at a first mounting site 3 on each side of the chair back, is moveable in relation to respective side members 4 on the chair, and at a second mounting site 5 forms a hinged connection with a rear part of the frame 7 of the chair seat 6. The frame 7 of the chair seat, at a rear mounting site 8 on each longitudinal side of the seat, is slideably connected to the respective side member 4 along a front, forward and upward inclining guide 9 which forms a part of the side member. The first mounting site 3 on the frame 2 of the chair back 1 is designed to slide along a rear, forward and downward inclining guide 10 in the side member 4. The seat frame 7, on each side of the seat, has a rear mounting site 11 located between said front mounting site 8 and said second mounting site 5 for the chair back 1. The rear mounting site 11 forms a slideable connection with a guide 12 in the respective side member 4, which is central when seen in the longitudinal direction of the side member 4. The central guide 12 may either be approximately horizontal or inclined slightly forward and upward when seen in the longitudinal direction of the chair.

The small wheels 13 of the wheelchair may be pivotally connected via a wheel fork 14 to a front part of the respective side member 4 of the chair. The large wheels 15 of the wheelchair may in a known way per se be connected to the chair side member 4. The chair frame 7, at the front edge thereof, may optionally be provided with a downward projecting part 7' for the support of a foot rest 7".

Figure 2:
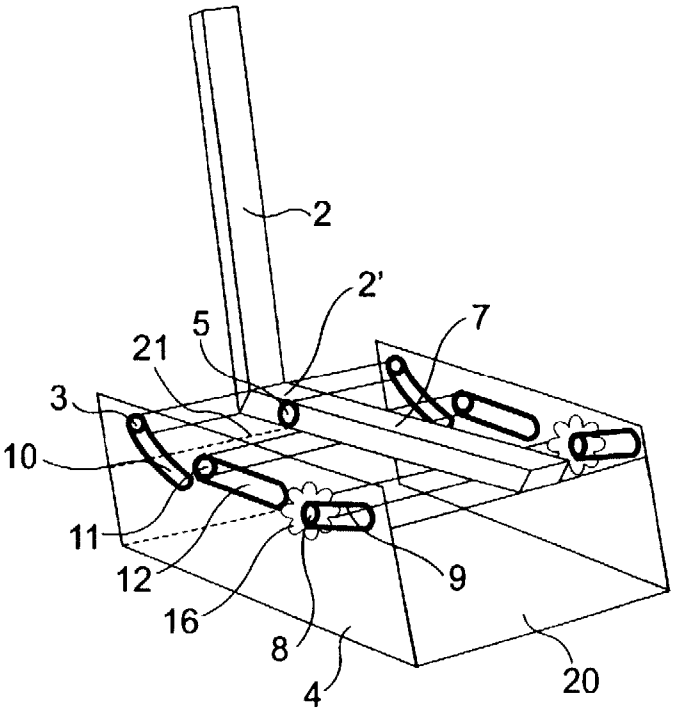
FIG. 2 is a more detailed view of the device according to the invention as shown in FIG. 1.

In order to secure a locking of the adjusted position of the chair seat 6 and back 1, a stepless, adjustable clamp coupling, schematically indicated and having the reference numeral 16 in FIG. 2, may be used in a known way per se. This clamp coupling may consist of an adjusting wheel and a friction disc, where the friction disc (not shown) comes to rest against the outside of the side member. The adjusting device may be rotatably connected to the said front mounting site on the seat frame. As can be seen from FIG. 1, the chair back may be provided with a headrest 17, which is of particular importance in connection with use for a wheelchair.

As can be seen clearly from the skeleton drawings in FIGS. 1 and 2, the chair back frame 2 has at the bottom a frame member 2' which projects forward in the longitudinal direction of the chair and forms an obtuse angle with the upwardly projecting part of the chair back 1. The free end of the frame member 2' forms a part of said second mounting site 5 as is shown.

Figure 3:
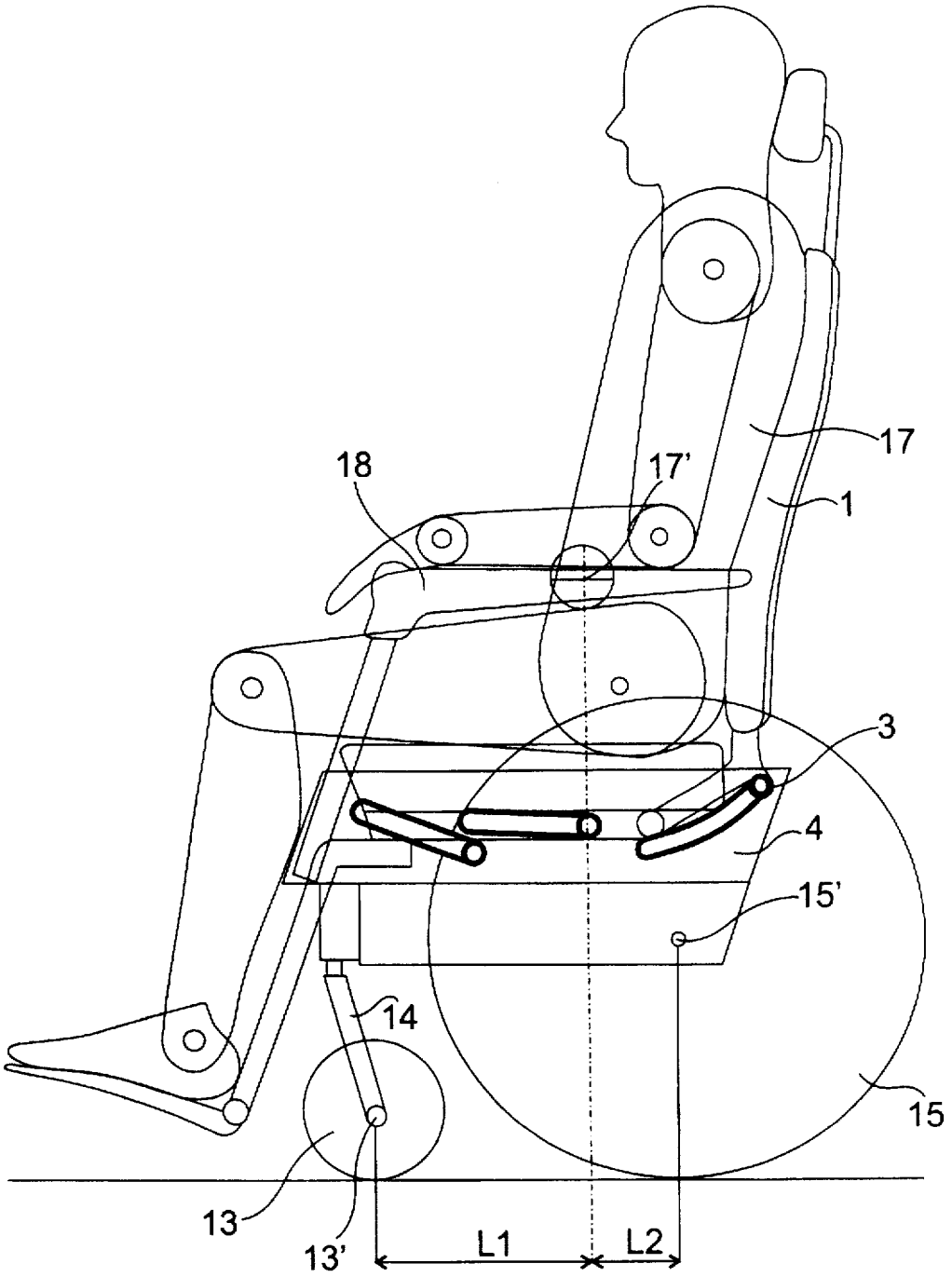
FIGS. 3, 4 and 5 show the application of the device according to the invention for a wheelchair in different positions of use.
Figure 4:
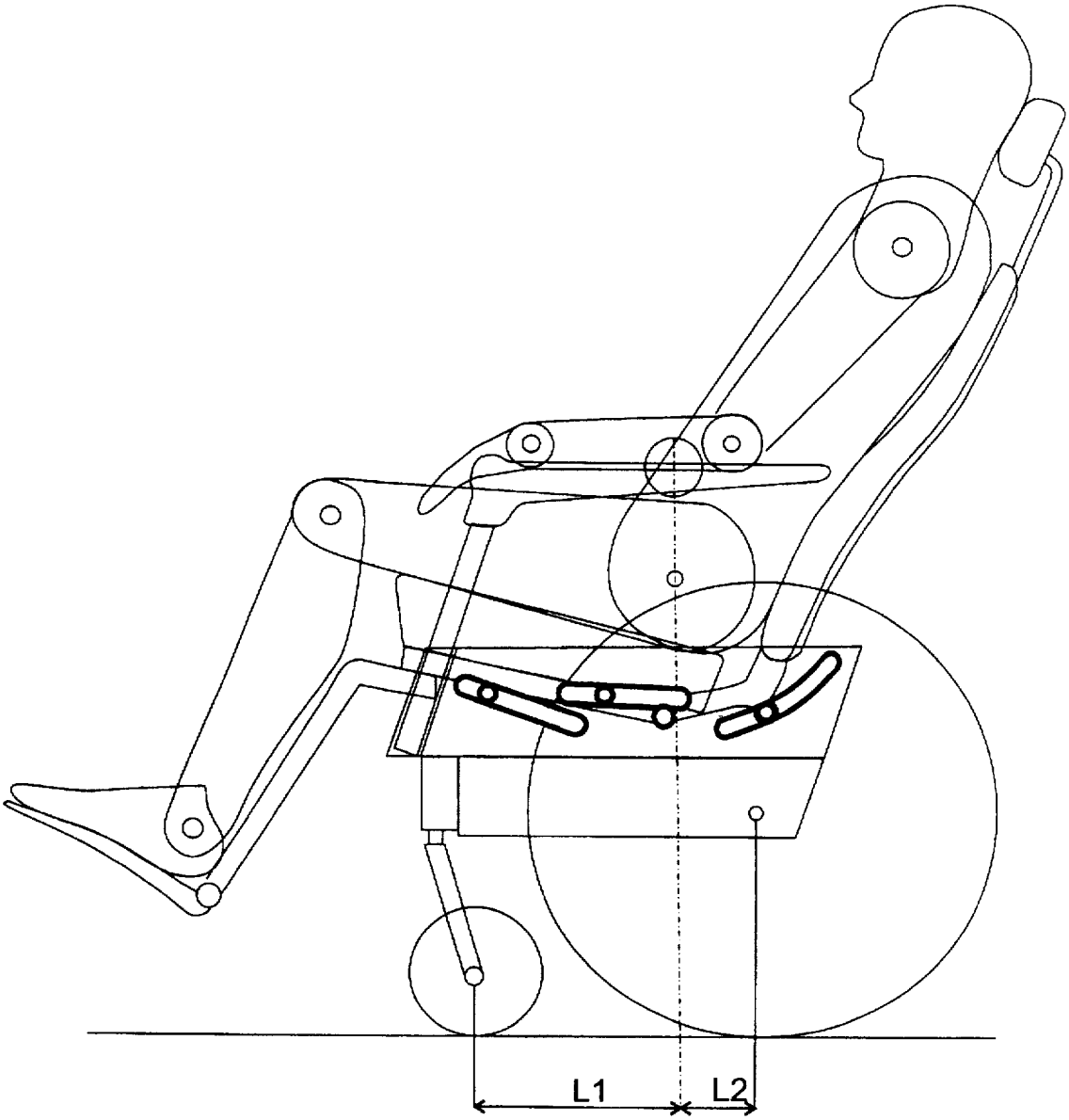
Figure 5:
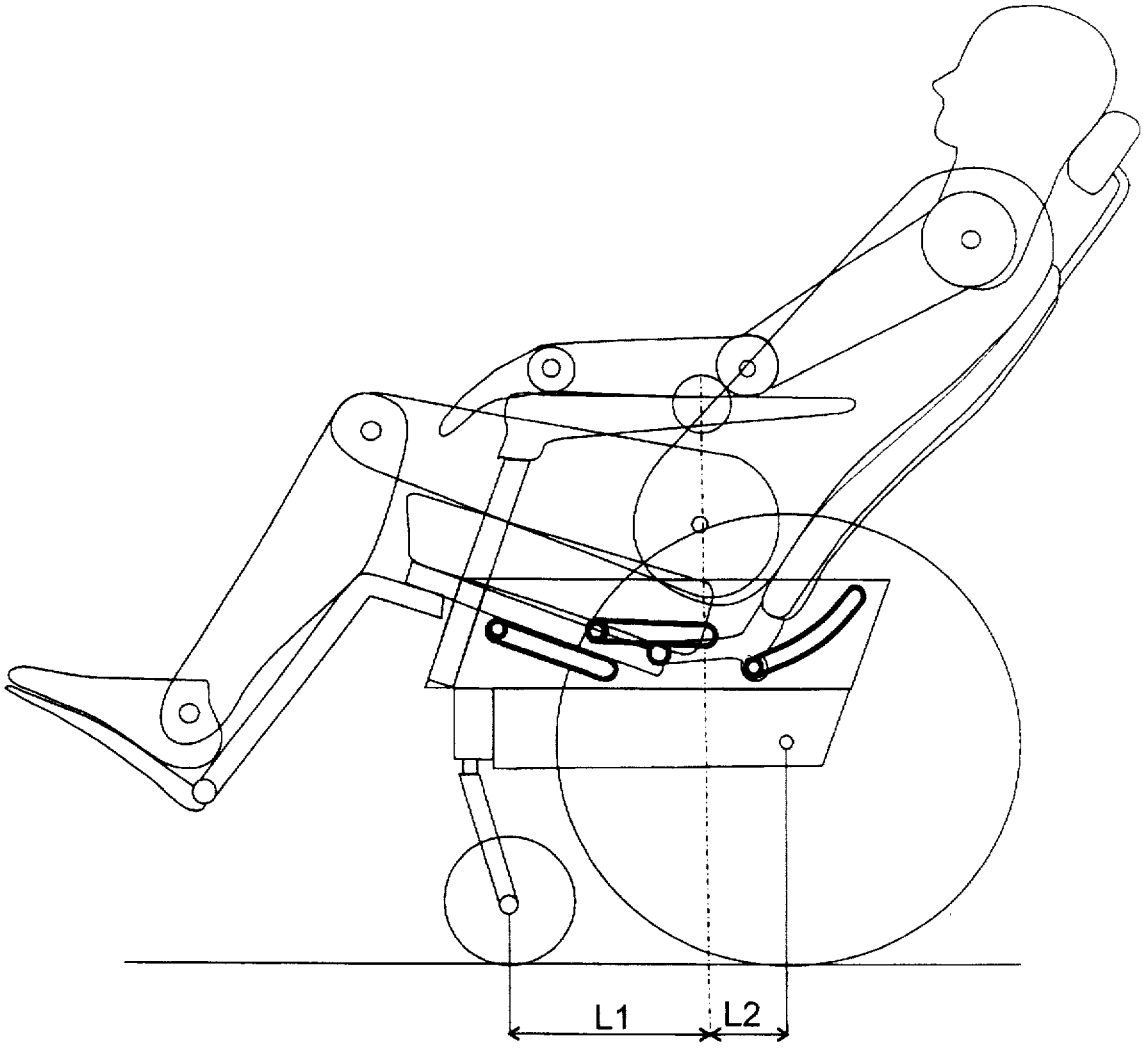

In FIGS. 3, 4 and 5, the device according to the invention is shown in connection with use in a wheelchair structure. The person sitting in the chair is indicated by means of the reference numeral 17 and the centre of gravity of the person is indicated by means of reference numeral 17'. The horizontal distance from the centre of gravity 17' to the centre of rotation 13' between the small wheel 13 and the supporting fork 14 is designated the distance L1. In a similar way, the horizontal distance between the centre of gravity 17' and the centre of rotation 15' of the large wheels 15 in connection with the side member 4 is designated L2. As can be seen from FIGS. 4 and 5, together with FIG. 3, the horizontal distance between the centre of gravity 17' and the centres of rotation 13' and 15' respectively, will essentially be the same irrespective of the position the chair user 17 assumes in the chair. It will also clearly be seen that the chair back 1 in the different sitting positions has not "climbed up" the chair user's back. This is due not least to the first mounting site 3 of the chair back moving downward when the chair user leans backward, whilst the chair seat is moved forward and upward. In the sitting position shown in FIG. 4, the chair user is in a medium resting position in the chair, whereas in FIG. 5 the full resting position has been assumed.

Figure 7:
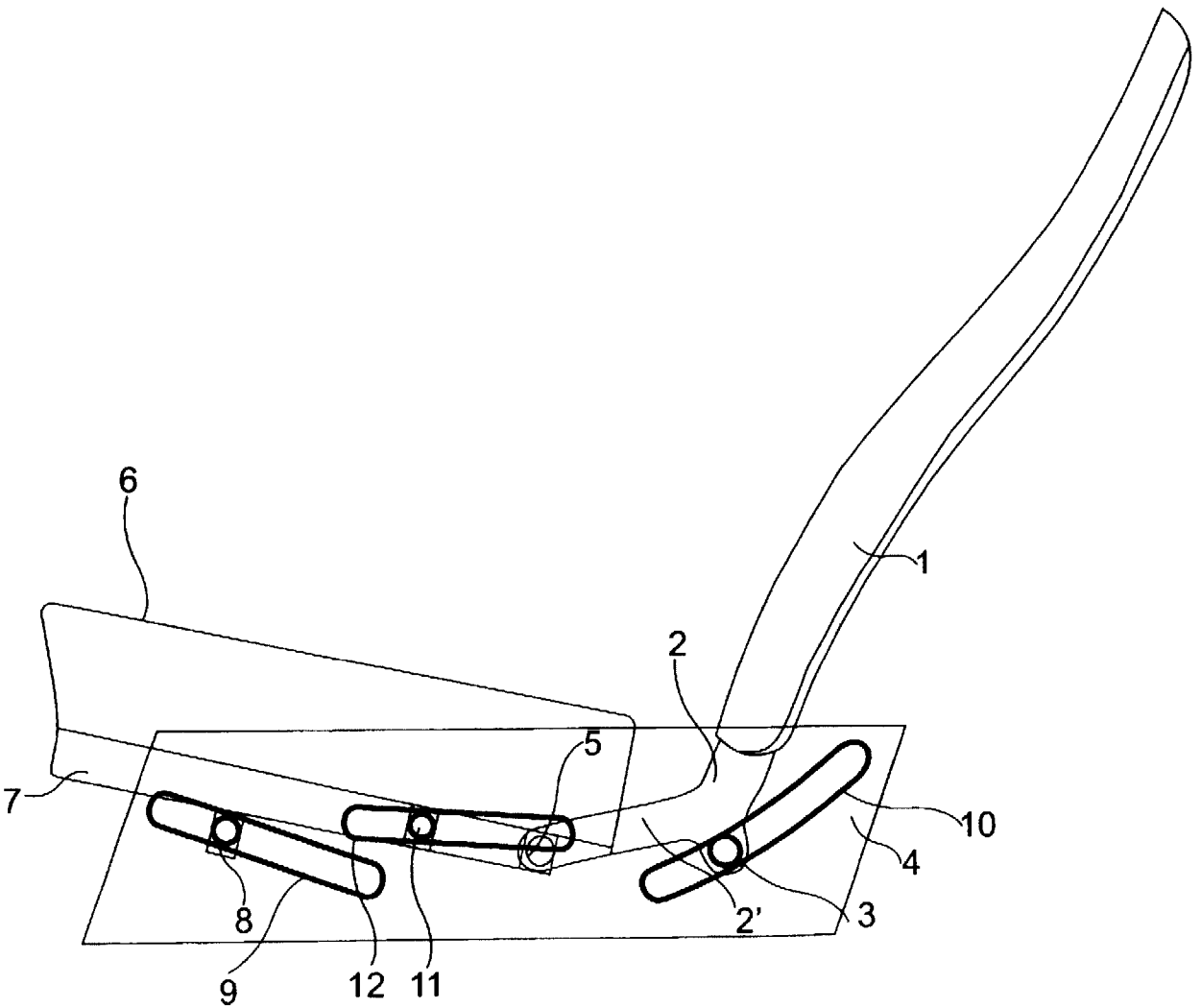
Figure 8:
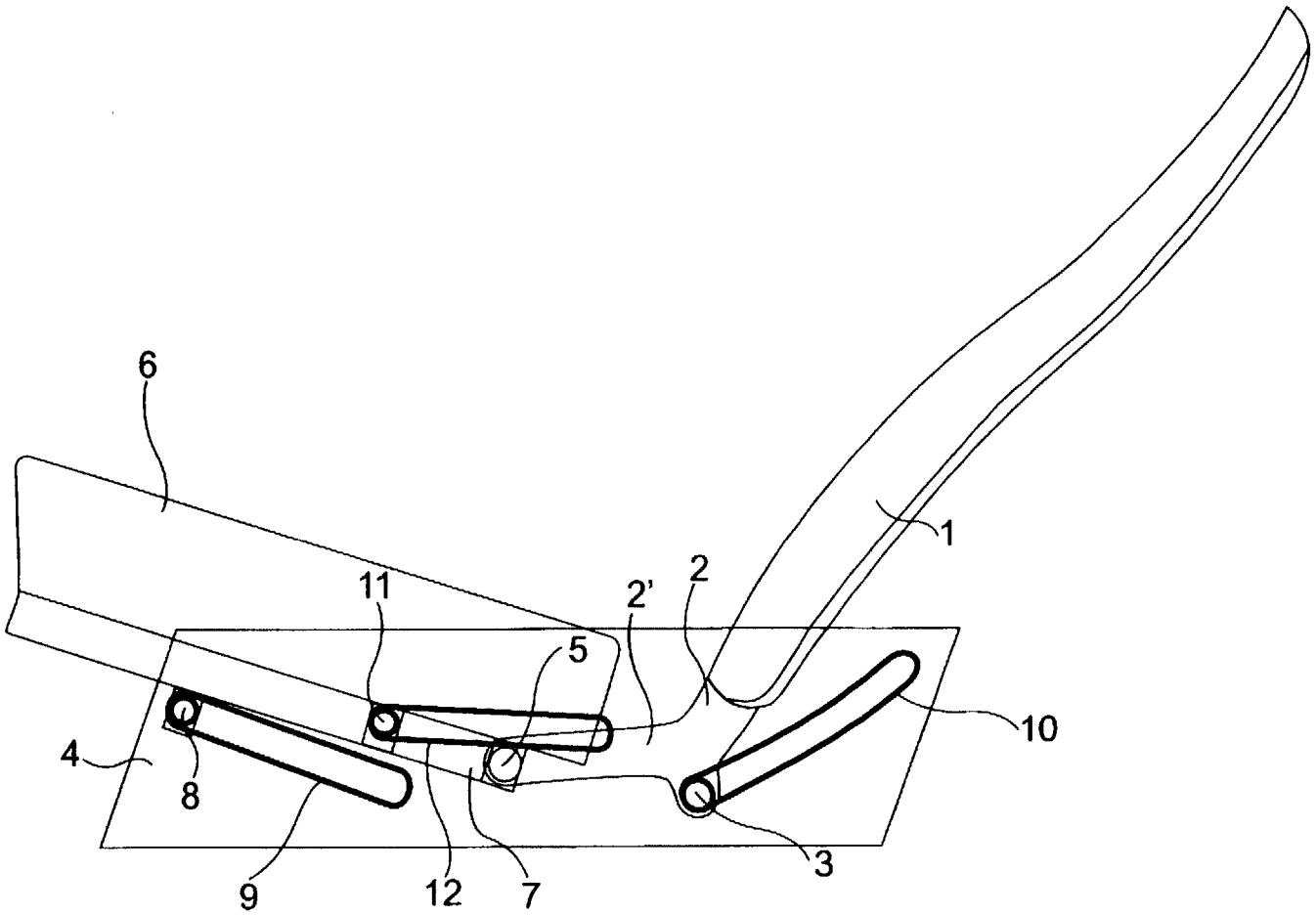

The reciprocal movements of the chair back, seat and mounting sites will be explained in more detail in connection with FIGS. 6, 7 and 8. The same reference numerals as have been used in the preceding figures are also used in FIGS. 6–8, insofar as they are necessary for the explanation.

Figure 6:
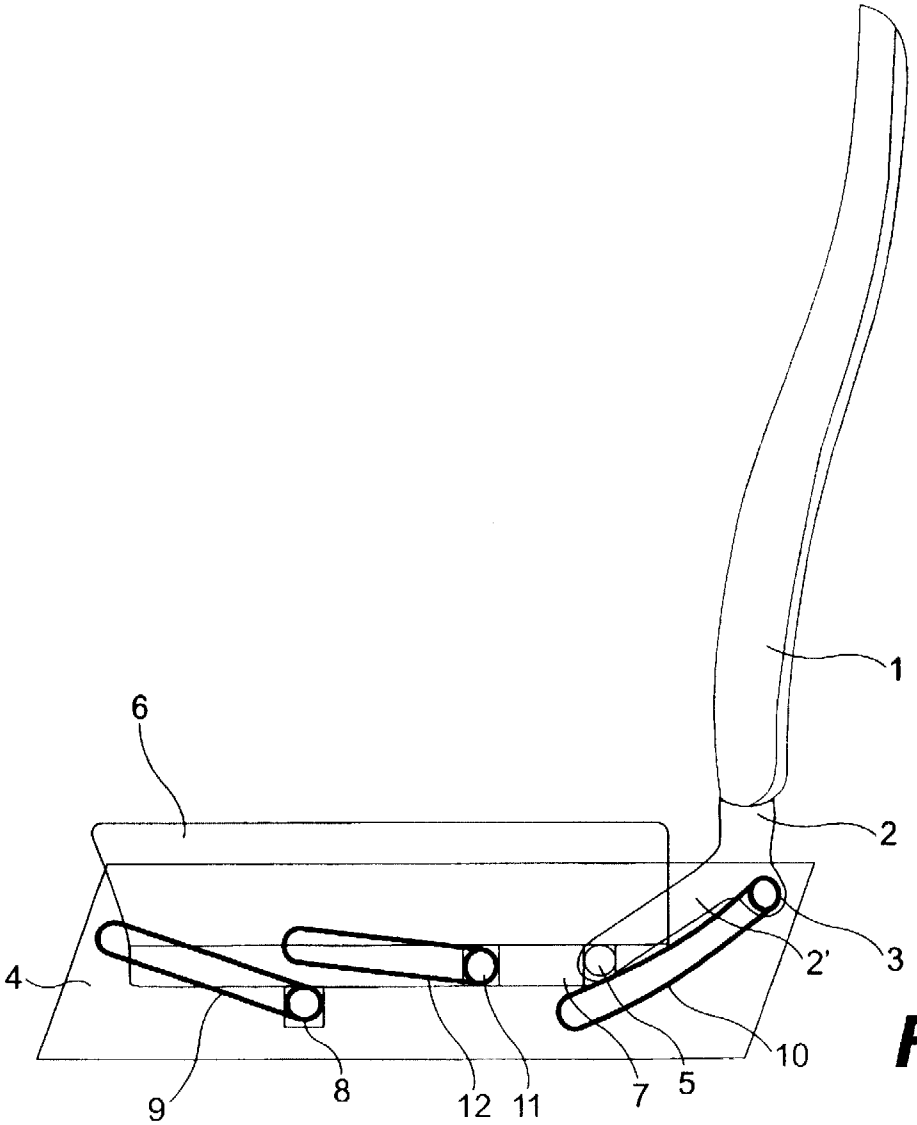
FIGS. 6, 7 and 8 show in an enlarged version the different settings of the seat and the back in relation to one another as shown in the respective FIGS. 3, 4 and 5 without wheelchair parts and a wheelchair user being included in the drawing.

As can be seen from FIG. 6, where the chair back 1 is shown in an erect position, the first mounting site 3, e.g., a pin or a roller, will be located at the rearmost end of the rear guide 10. In a similar way, the rear mounting site 11 on the seat frame 7, e.g., in the form of a pin or a roller, will be located in the rear end of the central guide 12. Similarly, the front mounting site 8 on the seat frame 7, e.g., in the form of a pin or a roller, will be located at the rear end of the front guide 9. When the chair user leans back, as is shown in FIG. 4, which corresponds to the situation which can be seen in FIG. 7, the first mounting site 3 will move downward along the guide 10. The rear mounting site 11 of the seat 6 moves forward correspondingly along the guide 12. Similarly, the front mounting site 8 will move forward and slantwise upward along the guide 9. This movement has been completed in FIG. 8, where the respective mounting sites 3, 11 and 8 have reached their forward end positions in the respective guides 10, 11 and 9. In this position, the seat has an upward and forward inclining position, approximately parallel to the longitudinal direction of the guide 9. Owing to the movement of the first mounting site 3 along the guide 10, the second mounting site between the frame member 2' of the back and the back edge of the seat frame 7 will also necessarily move both downward and forward. Seen in relation to FIG. 6, the back edge of the seat 6 and the lower part of the chair back 1 will have moved apart from one another, whilst the lower part of the chair back lies below the level of the upper back edge of the seat. In this way, the user is prevented from having the sensation of the chair back apparently "climbing up" his back when he leans back in the chair. The use of the rear mounting site 11 and also the guide 12 is essential to prevent the chair user, on making further attempts to lean back, from causing the chair back to move even further backward in order to assume a horizontal or downward and backward lying position, as the mounting site 5 in this case would ascend toward the top edge of the side member. The interaction between the different mounting sites 3, 5, 11 and 8, and also the use of the guides 10, 12 and 9 in connection with the mounting sites 3, 11 and 8, is thus essential in order to achieve the desired function of the device. The use of the projecting member 2' of the chair back frame 2 also constitutes an essential part of the overall structure.

Figure 10:
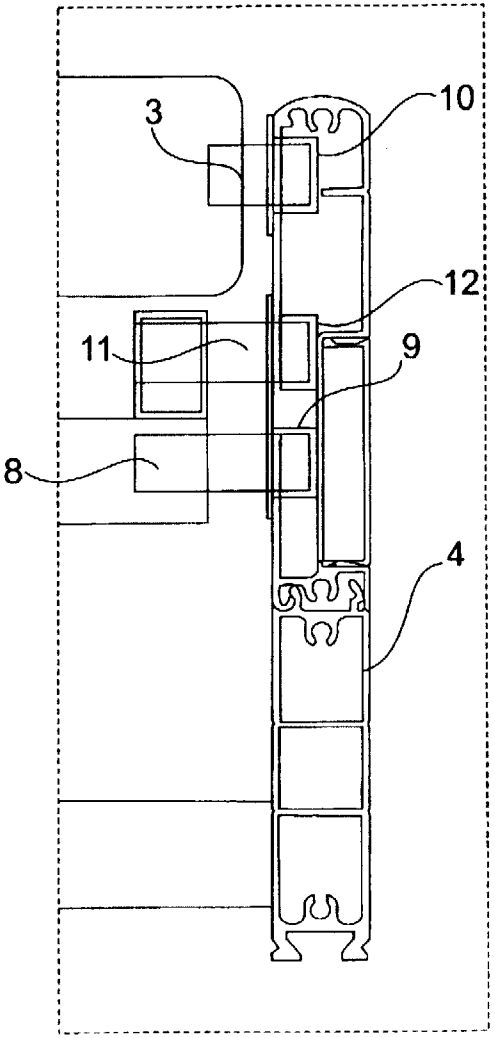
FIG. 10 shows the section X in FIG. 9.
Figure 9:
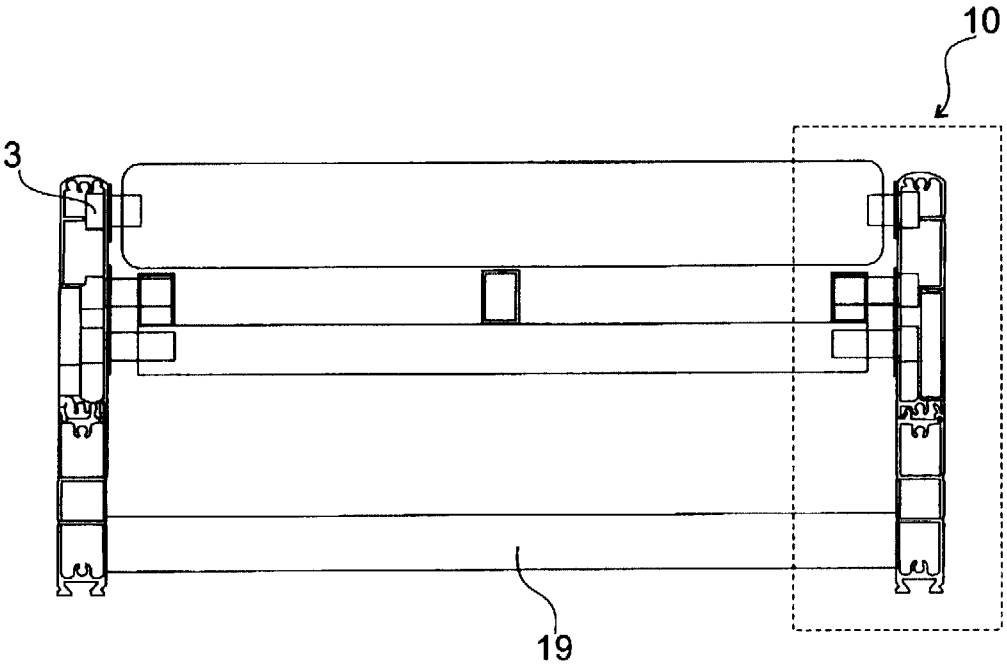
FIG. 9 shows a cross-section of a chair seat with side members according to the invention.

FIGS. 9 and 10 are purely schematic illustrations of a practical embodiment which illustrates the respective mounting sites 3, 11 and 8, the associated guides 10, 12 and 9, the seat frame 7 and the side members 4. The side members 4 are made of extruded profile bodies. The extruded profile shown in the drawings is not necessarily limiting for the embodiment in question.

By means of the present invention, a structure is thus achieved, where the possibilities of good sitting comfort and tilting are achieved in that the sitting unit is tilted with the centre thereof in the centre of gravity 17' of the body 17. The centre of gravity of the body in relation to the chair is thus kept almost constant, seen in the horizontal direction of the chair, but also in the vertical direction thereof. As can be seen from FIGS. 3–5, the L1/L2 ratio is the same in all adjustable positions of the chair device.

With the chair according to the invention, the advantage is achieved that both the seat angle and the back angle are changed simultaneously, but with a greater angular excursion for the back. This results in a better sitting position for the chair user. The present structure also enables a chair user, e.g., a disabled person, to adjust the tilting of the chair himself without any help from an escort.

By virtue of the fact that the centre of gravity of the body in relation to the longitudinal direction of the chair is kept virtually constant during the adjustment of the chair, a minimum reduction of the reciprocal centre distance between the wheels 13 and 15 is achieved, which helps to improve the driving properties without this being to the detriment of the backward tilting safety of the wheelchair.

When constructing the supporting structure, a principle is used in connection with wheelchairs where the sitting unit (corresponding to the back frame 2, including back frame member 2', the seat frame 7 and leg supports 7', 7") as a separate unit constantly follows the user's movements from an active to a passive position, and vice versa.

The sitting unit moves between the two side members 4'. The position of the guides 10, 12 and 9 gives the angular path along which the sitting unit will move. The side members 4 will in reality correspond to the complex and heavy carriage frame in a conventional wheelchair structure. In addition, these side member profiles, in a simple manner, will serve as attachments for wheels, wheel brakes, arm rests 18, handles and so forth.

The present structure makes possible the use of a relatively low number of parts. The use of side members in the form of extruded aluminium profiles will give greater flexibility with a view to model variations and different chair sizes, at the same time as a simple structure is achieved. The chair will be simple to mount and adjust and will provide possibilities for rational transport and storage. The side members can be connected by means of stabilising bars 19. Optionally, the side members at the front edge and back edge thereof can be provided with stabilising cross braces 20, 21 as indicated in FIG. 2.

As can be seen from the drawings, the rear guide is preferably slightly U-shaped. It may form an angle with the horizontal in the range of 15°–45°, in a preferred embodiment of the invention. Furthermore, the central guide 12 may form an angle with the horizontal in the range of 0°–15°. The front guide 9 should preferably form an angle with the horizontal in the range of 10°–45°. As also can be seen from FIG. 10, the grooves which are made in the side members 4 to create the respective guides 10, 12 and 9 may have a slide lining, so that there is no risk of unwanted wear occurring in said grooves on the side members of the chair.

What is claimed is:

1. A device for an adjustable chair, where the back of said adjustable chair, at a first mounting site on each side thereof, is pivotally connected to respective side members of the chair, and at a second mounting site forms a hinged connection with a rear part of a chair seat frame, where the chair seat frame, at a front mounting site on each side thereof, is slidably connected to one of the respective side members along a front guide which forms a part of the side member, wherein said first mounting site on the chair back is designed to slide along a rear, forward and downward inclined guide in the side member, and wherein the seat frame on each side has a rear mounting site between said front mounting site and said second mounting site for the chair back, said rear mounting site forming a slidable connection with a central guide in each respective side member, which is located between the front guide and the rear guide when seen in the longitudinal direction of the side member, characterized in that the front guide is inclined forward and upward and forms an angle with the horizontal in the range of 10°–45°, that the central guide forms an angle with the horizontal in the range of 0°–15°, and that the rear, forward and downwardly inclined guide is slightly curved, and forms an angle with the horizontal in the range of 15°–45°.

2. The device of claim 1, wherein the side members are made of extruded aluminum.

3. The device of claim 1, wherein the front mounting site and the front guide are formed such that friction therebetween is adjusted by means of a steplessly adjustable mechanism.

4. The device of claim 1, wherein a bottom of the back of the chair has a frame member which projects forward in the longitudinal direction of the chair and forms an obtuse angle with an upward projecting part of the back, a free end of said frame member forming a part of said second mounting site.

5. The device of claim 1, wherein the central guide is inclined forward and upward with an angle not exceeding 15° relative to the horizontal.

6. The device of claim 1, wherein the guides include grooves milled out in a side surface of the side member.

7. The device of claim 6, wherein grooves are provided with a slide lining.

* * * * *